United States Patent [19]

Gilbertson

[11] Patent Number: 4,480,685

[45] **Date of Patent: * Nov. 6, 1984**

[54] OIL WELL PUMP DRIVING UNIT

[76] Inventor: Thomas A. Gilbertson, 216 Sandringham, N., Moraga, Calif. 94566

[ * ] Notice: The portion of the term of this patent subsequent to Mar. 23, 1999 has been disclaimed.

[21] Appl. No.: 334,245

[22] Filed: Dec. 24, 1981

Related U.S. Application Data

[63] Continuation-in-part of Ser. No. 183,958, Sep. 3, 1980, Pat. No. 4,320,799.

[51] Int. Cl.[3] ..... F04B 47/04

[52] U.S. Cl. ..... 166/68.5; 166/84; 166/72; 92/161

[58] Field of Search ..... 166/68.5, 72, 84; 92/161; 417/398; 277/30

[56] References Cited

U.S. PATENT DOCUMENTS

| | | | |
|---|---|---|---|
| 3,289,791 | 12/1966 | Ulinski | 277/30 |
| 3,887,196 | 6/1975 | Renfrou | 277/30 |
| 4,345,766 | 8/1982 | Turanji | 277/30 |

*Primary Examiner*—William F. Pate, III

*Attorney, Agent, or Firm*—Flehr, Hohbach, Test, Albritton & Herbert

[57] ABSTRACT

An oil well pumping apparatus which includes a submerged reciprocating pump mounted in a tubing arrangement communicating with the wellhead, a sucker rod string extending through the tubing arrangement and connected in driving relation with the pump, and a pumping tee and stuffing box arrangement mounted on the casing of the well at the wellhead and including a sealed drive rod arrangement in the stuffing box connected in driving relation to said sucker rod string, and a pump driving unit. The pump driving unit includes a hydraulic cylinder and support means including a gimbal arrangement for supporting the hydraulic cylinder over the stuffing box with the axis of the cylinder rod aligned with the axis of said stuffing box. A coupling means is provided for coupling the cylinder rod to the sealed drive rod arrangement. A hydraulic drive/control unit is coupled to said in/out fluid line for operating cycle consisting of a hydraulic power upstroke and a gravity power downstroke. An assist cylinder and accumulator combination are provided to counteract part of the weight of the rod string and thus reduce the workload on the hydraulic fluid pump.

16 Claims, 8 Drawing Figures

OIL WELL PUMP DRIVING UNIT

This application is a continuation-in-part of U.S. patent application Ser. No. 183,958, filed Sept. 3, 1980, now U.S. Pat. No. 4,320,799.

This invention relates generally to oil well pump driving units and, more specifically, to oil well pump driving units utilizing an hydraulic cylinder to produce a relatively slow pumping stroke.

One of the conventional styles of oil well pump driving units is the walking beam, horsehead unit in which the walking beam and horsehead are driven in a rocking motion. A cable arrangement running over the horsehead is utilized to raise and lower a polished rod which extends through a stuffing box arrangement mounted above the pumping tee on the wellhead casing. The other end of the polished rod is connected to a sucker rod string which extends downhole and is connected on the other end to one of the conventional types of reciprocating pumps.

This conventional type of pump driving unit comes in various sizes to produce various pump stroke lengths depending on the capacity of the well. For smaller wells, units with a stroke length between above twelve and twenty inches per stroke are used. For larger wells, units with a stroke length between 40 and 170 inches per stroke may be used.

Typically, these types of pumping units are run at fairly high stroke rates of anywhere from about 8 to 12 strokes per minute on the smaller units to 12 to 30 strokes per minute on the larger units. The rapid reciprocating motion of the rod string, including the polished rod and the sucker rod string extending down the bore hole, produces certain undesirable operating effects. From a mechanical standpoint, this rapid reciprocation produces acceleration, shock and harmonic loading of the rod string with accompanying high peak rod loads, all of which shorten the life of the rod string. Moreover, it is well known that the rapid pumping stroke of this type of pump driving unit reduces the volumetric pump efficiency due to the rate at which the pump is attempting to move oil up the tubing string and because of the agitation and pounding of the fluid in the well.

An additional problem that can be encountered in pumping light oil ( i.e., oil which has a substantial volume of dissolved gas) is gas lock of the pump. Gas lock is generally caused by the gas released from the oil in the formation at a rapid rate as the pressure drops in the pump on the upstroke. If the pressure on the head of liquid in the bore hole is not sufficient to compress the gas released into the pump chamber on the upstroke, the pressure of the expanded volume of gas at the top of the pump barrel will not exert sufficient pressure on the traveling valve to counteract the pressure of the fluid column on that valve. Consequently, the valve will not open and no fluid will be moved by the pump. Under this condition, the plunger in the pump merely compresses and expands the gas in the pump barrel. This gas lock problem can make it extremely difficult to pump some very gaseous wells. Even if a complete gas lock does not occur, the building up of gas in the pump barrel reduces substantially the effective oil pumping capacity due to the volume occupied by the gas.

Very large capacity wells, in the range of 200–500 barrels per day, justify the use of an expensive cable-type pumping unit, such as the Alpha pump unit manufactured by Bethlehem Steel Corporation, to produce a long, slow pump stroke. The Bethlehem Alpha pumping unit utilizes a pair of spiral cam arrangements mounted on a common shaft, each carrying a cable which is attached either to the sucker rod string through a traveling stuffing box arrangement or to a counterweight arrangement which traverses a counterweight well which must be sunk into the ground near the wellhead. The Bethlehem Alpha rig is an expensive pump driving unit which is cost effective only in large capacity wells, but its typical forty foot stroke and three per minute stroke rate produces a long, slow pump stroke cycle which eliminates the above-mentioned problems inherent in the walking beam pumping unit.

While the Bethlehem Alpha type of pumping unit is available for the larger wells, pump driving units for producing a relatively slow stroke for smaller wells were not commercially available until recently. In some areas, the characteristics of certain wells are such that a small walking beam pump unit simply performs so inefficiently in pumping the oil or is subject to intolerably repetitive gas lock conditions that the wells simply are unproductive and remain capped.

In a copending Gilbertson application entitled "Oil Well Pump Driving Unit", Ser. No. 148,380, filed May 9, 1980, an oil well pump driving unit utilizing an hydraulic cylinder to produce a relatively long, slow pumping stroke is disclosed. In this copending application, the hydraulic cylinder is mounted in a horizontal orientation adjacent the well head and coupled to the sealed drive rod arrangement in a traveling piston-type stuffing box by way of a cable and sheave arrangement which translates the horizontal motion of the cylinder rod into a vertical motion for driving the rod string of the pumping arrangement and the coupling arrangement between the cylinder rod and the rod string disclosed therein provide an advantageous pumping action for relatively high capacity wells requiring a stroke length substantially greater than ten feet.

Certain prior art patents disclose oil well pump driving units in which an hydraulic cylinder is utilized to power the rod string driving the reciprocating pump at the bottom of the well. For example, Mason U.S. Pat. No. 1,708,584 and Palm U.S. Pat. No. 1,845,176 disclose oil well pump driving units in which an hydraulic cylinder is mounted directly over a pumping tee and stuffing box arrangement at the wellhead. In the Mason patent a very complicated structural arrangement utilizing a support tower is provided for supporting the hydraulic cylinder. Moreover, a double-acting hydraulic cylinder together with a counterweight arrangement supported on the steel tower structure is utilized in the pump driving unit disclosed in the Mason patent.

The Palm patent discloses a somewhat simpler mounting arrangement for the hydraulic cylinder but also discloses a complex structural arrangement for mounting counterweights which require the use of a double-acting hydraulic cylinder. Moreover, in the Palm patent, the mounting flange of the hydraulic cylinder is apparently formed in an integral fashion with a horizontal support plate carrying two counterweight pulleys with the overall arrangement providing no apparent compensation for any alignment error between the support plate and cylinder and the axis of the stuffing box and pumping tee arrangement. Both the support structure shown in the Mason patent and that disclosed in the Palm patent require a complicated assembly operation for mounting the hydraulic cylinder at the wellhead.

Accordingly, it is an object of this invention to provide an improved oil well pump driving unit utilizing an hydraulic cylinder mounted directly over the pumping tee and stuffing box arrangement at the wellhead.

It is another object of this invention to provide an hydraulic oil well pump driving unit which includes structural components easy to assemble at the wellhead and having provision for self-alignment of the hydraulic cylinder axis with the axis of the pumping tee and stuffing box arrangement at the wellhead.

It is another object of this invention to provide an improved hydraulic pump driving unit which includes an assist cylinder and accumulator arrangement.

The pump driving unit of this invention is adapted to be utilized in an oil well pumping apparatus which includes a submerged reciprocating pump mounted in the bottom of a tubing arrangement communicating with the wellhead, a sucker rod string extending through the tubing arrangement and connected in driving relation with the pump, and a pumping tee and stuffing box arrangement mounted on the casing of the well at the wellhead and including a sealed drive rod arrangement in the stuffing box connected in driving relation to the sucker rod string. The pumping tee and stuffing box arrangement may comprise either a stationary stuffing box with sealing glans and polished rod arrangement or an inverted stuffing box arrangement involving a drive rod piston traveling in a polished tube having a length corresponding generally to the maximum length of the pumping stroke.

The improved pumping apparatus of this invention which includes an assist cylinder and accumulator arrangement may be utilized in connection with any hydraulic pump driving unit including the units disclosed in copending Gilbertson patent applications bearing Ser. Nos. 148,380 and 237,366, and filed May 9, 1980 and Feb. 23, 1981, respectively.

One aspect of this invention features a pump driving unit which comprises an hydraulic cylinder, including a cylinder rod and an in/out hydraulic fluid line and a support means for supporting the hydraulic cylinder over the stuffing box with the axis of the cylinder rod aligned with the axis of the stuffing box. A coupling means is provided for coupling the cylinder rod to a sealed drive rod arrangement in the stuffing box, and an hydraulic drive/control means is coupled to the in/out fluid line of the cylinder for operating the cylinder to produce an hydraulic power upstroke and a gravity power downstroke. The support means of this invention comprises a cylinder support assembly including a cylinder support plate, and structural means mounting the cylinder support plate above the pumping tee and stuffing box arrangement in a plane generally perpendicular to the axis of the stuffing box. The cylinder support assembly further includes gimbal means for supporting the cylinder in an axially-floating manner on the cylinder support plate to adjust automatically the orientation of the axis of the cylinder into alignment with the axis of the stuffing box when the weight of the sucker rod string is applied to the cylinder rod. This automatically compensates for any small errors in the positioning of the cylinder support plate perpendicular to the axis of the stuffing box and the sealed drive rod extending there through.

In a preferred embodiment the cylinder support plate includes an aperture which receives the cylinder rod and the gimbal means includes a generally spherical gimbal bearing located on the cylinder support plate surrounding the cylinder rod aperture and a gimbal plate supporting the mounting flange of the hydraulic cylinder on a top surface thereof and having a spherically shaped bearing cup formed in a bottom surface thereof to match the spherical gimbal bearing. The gimbal plate has an aperture therethrough generally aligned with the aperture in the cylinder support plate. With this arrangement, a small degree of rotation in any direction is permitted between the gimbal plate and the cylinder support plate. Preferably the gimbal bearing is integrally formed on the top surface of the cylinder support plate.

The structural means supporting the cylinder support plate preferably comprises a choke assembly including a pair of collar plates with complementary semicircular collar surfaces formed thereon matching the outside surface of the well casing or a tubing element on the wellhead above the casing and a clamping arrangement for tightly clamping the collar plates together such that the plane of the collar plates is generally perpendicular to the axis of the stuffing box mounted in the well casing. At least a pair of support leg arrangements are provided, each including a support leg supported at one end on the collar plates with the other end extending above the pumping tee and stuffing box arrangement. The structural means further includes mounting means for mounting the cylinder support plate on the support legs in a plane substantially parallel to the plane of the collar plates.

In accordance with another aspect of this invention, an assist cylinder and accumulator arrangement is provided for an hydraulic oil well pumping apparatus. This feature can be used in any oil well pumping apparatus which includes a submerged reciprocating pump mounted in a tubing arrangement communicating with the wellhead, a sucker rod string extending through the tubing arrangement and connected in driving relation with the pump and pumping tee mounted on the tubing arrangement. The pump driving unit comprises first and second hydraulic fluid cylinders having first and second cylinder rods coupled together in common driving relation and first and second hydraulic fluid in/out lines. Mounting means are provided for mounting the first hydraulic cylinder in operative position at the wellhead. Means are also provided for coupling the first cylinder rod in sealed driving relation to the sucker rod string. Hydraulic drive/control means is coupled to the first in/out fluid line of the first hydraulic cylinder to produce a cylinder operating cycle which consists of a hydraulic power upstroke and a gravity power downstroke. The hydraulic drive/control means includes a hydraulic generator having hydraulic power and return lines.

An accumulator is coupled to the second in/out fluid line and contains a compressible gas charge which is further pressurized by hydraulic fluid from the second hydraulic cylinder on the gavity power downstroke to counteract at least partially the weight of the sucker rod string throughout the hydraulic power upstroke. A pressure reduction valve and a check valve are coupled in series between the hydraulic power line and the second in/out fluid line for controlling the minimum pressure in the second hydraulic cylinder at the top of the hydraulic power upstroke. A pressure relief value is coupled between the second in/out fluid line and the return line for controlling the maximum pressure in the second hydraulic cylinder at the bottom of the gravity power downstroke.

Oil well pump driving units in accordance with this invention advantageously provide for self-alignment of the axis of the hydraulic cylinder with the axis of the stuffing box arrangement at the wellhead. The choke assembly together with the support assembly clamped to the support legs provides generally for a high degree of self-alignment of the respective structural elements utilizing one of the wellhead components itself as an alignment reference. The gimbal mounting arrangement for supporting the cylinder on the cylinder support plate automatically provides whatever compensation may be required for the axial position of the cylinder to precisely align it with the axis of the stuffing box when the weight of the rod string is coupled to the cylinder rod.

The overall structural arrangement of this invention thus eliminates any side loading of the cylinder rod and the corresponding wear on the cylinder which would otherwise be produced by such side loading. Moreover, the structural arrangement of this invention provides for rapid assembly of the oil well pumping apparatus at the wellhead utilizing relatively unskilled labor capable of following simple assembly instructions. The assembly operation is simplified by the straightforward manner in which the various components fit together so that the complete setup of the pump driving unit can be accomplished within a few hours of arrival of the parts at the wellhead.

The pump driving unit of this invention has the advantageous slow pumping stroke which is preferred for pumping efficiency. With a simple interval timer based hydraulic drive/control unit, control over pump stroke length and rate are readily achieved. Actual field test results of pump driving units according to this invention have demonstrated well production as much as three times greater than the fluid produced by conventional walking beam, horsehead unit. In addition, the pump driving unit of this invention has demonstrated that it can overcome gas lock in a well. In at least one instance, production of well fluid was achieved using the pump driving unit of this invention where a conventional horsehead pumping unit could not produce the well at all.

The accumulator and assist cylinder feature of this invention enables the use of a smaller sized motor for driving the hydraulic fluid pump since the accumulator and assist cylinder operate as a counterbalance against at least part of the weight of the sucker rod string throughout the hydraulic powered upstroke. By enabling the use of a smaller motor, energy costs for operating the pumping unit are substantially reduced. Deeper wells can be produced using the same pump horsepower as used for shallower wells without the assist cylinder. The improved assist cylinder and accumulator arrangement of this invention provides a ready way of initially charging the assist cylinder and accumulator with hydraulic fluid. It also proves complete control over the maximum and minimum pressures in the assist cylinder so that the assist function can be maintained at an optimum level without risking buildup of an overpressure in the assist cylinder which would preclude dropping of the rod string on the gravity power downstroke. The tandem mounting of the assist cylinder and the simple integration of the assist cylinder and accumulator hydraulic circuitry into the hydraulic drive/control unit of the main cylinder enable the assist cylinder/accumulator function to be accomplished without adding substantial difficulty in installing the pump driving unit on the well.

Other objects, features and advantages of this invention will be apparent from a consideration of the following detailed description in conjunction with the accompanying drawings.

FIG. 1B is at partial elevational view of a cylinder support arrangement in accordance with this invention.

Figure 1:
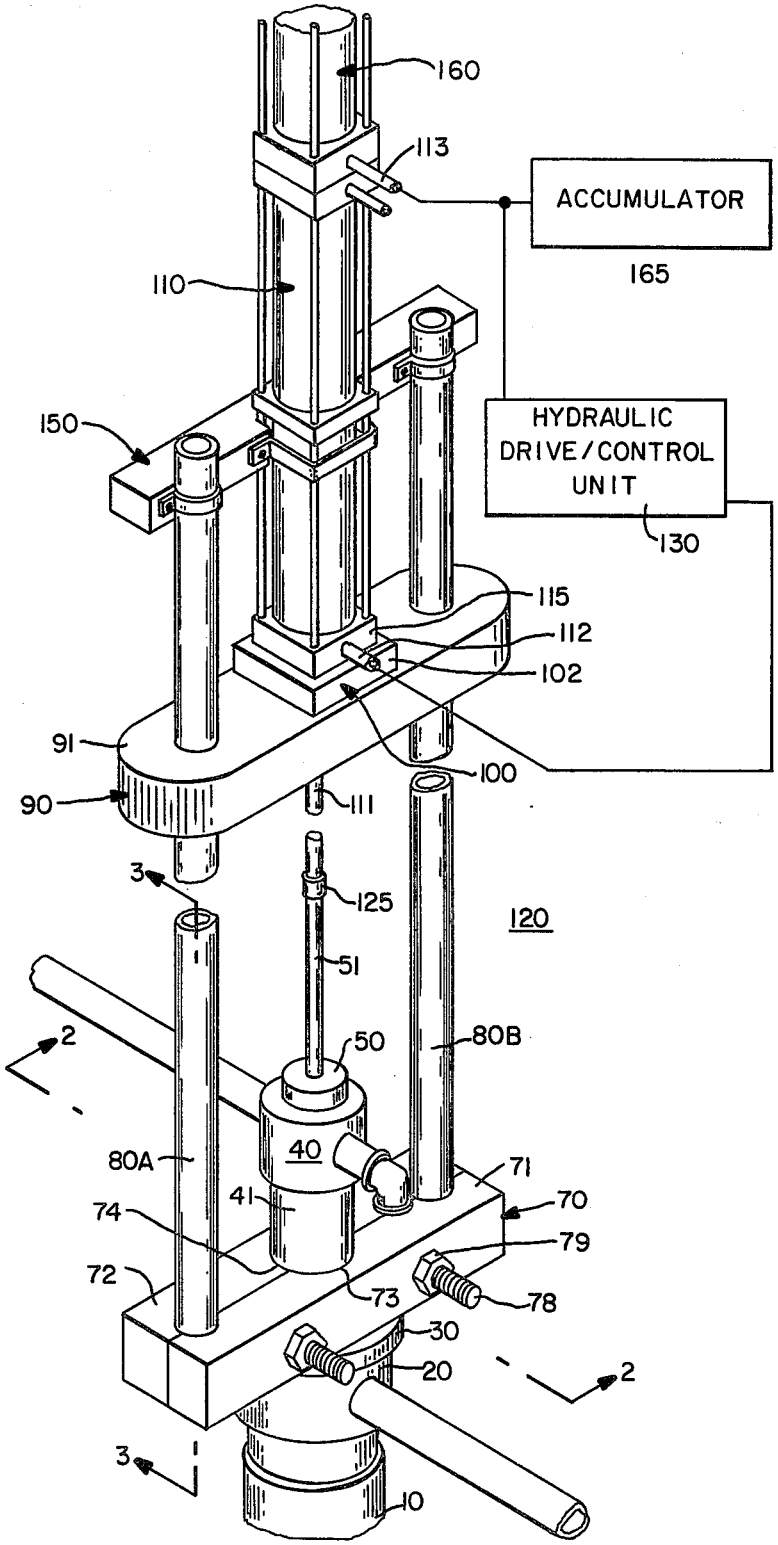
FIG. 1 is an isometric view of an oil well pump driving unit in accordance with this invention.
Figure 2:
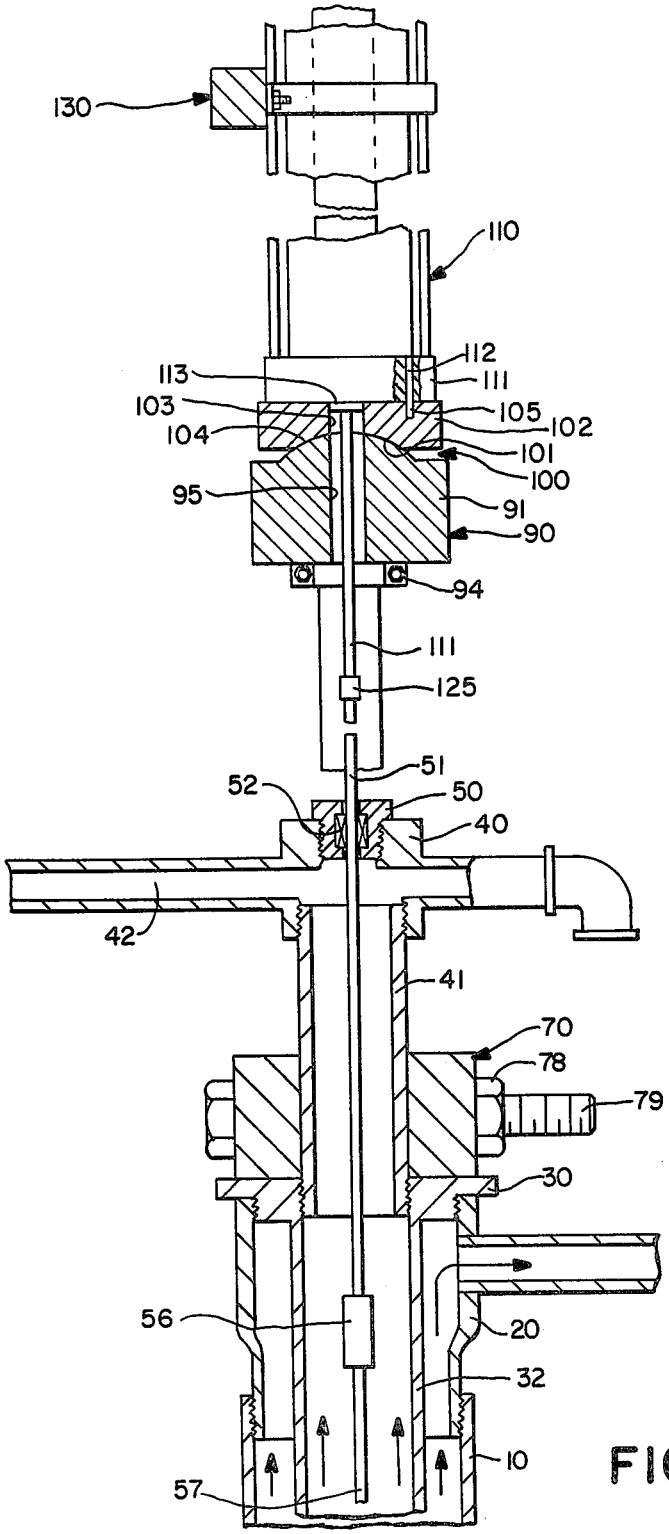

FIGS. 1 and 2 illustrate the operating environment for an oil well pump driving unit in accordance with this invention. As illustrated in FIG. 1, the wellhead of a typical oil well includes a production casing (not shown) which extends a short distance into the ground and supports a well casing arrangement 10 using one of several conventional support arrangements. In the top opening of casing 10, a gas tee 20 is usually provided for exhausting gas from the casing. Mounted on the top of gas tee 20 is a tubing hanger 30 which supports the long tubing string 32 communicating between the top of the wellhead and a conventional reciprocating pump (not shown) at the bottom of the bore hole. An oil pumping tee 40 is mounted on top of tubing hanger 30 by way of tubing section 41 and is in communication with the interior of the tubing string 32 for providing an exit channel 42 for oil pumped out of the bore hole. A stuffing box arrangement 50 is mounted on pumping tee 40 and includes a polished rod 51 which traverses a lubricated packing glan 52 and is coupled via a coupling element 125 to cylinder rod 111 of hydraulic cylinder 110.

All of the aforementioned items except the hydraulic cylinder are relatively standard wellhead equipment. Instead of the polished rod, stuffing box arrangement shown in FIG. 2, an inverted stuffing box of the type shown in parent application Ser. No. 183,958 could be used. The polished rod 51 is connected via a rod box 56 to the sucker rod string 57.

FIGS. 1 and 2 also depict the major components of a pump driving unit in accordance with this invention. These major components include an hydraulic cylinder 110 with a cylinder rod 111, an in/out hydraulic fluid line 112 and a top exhaust port 113. A support means 120 is provided for supporting hydraulic cylinder 110 over stuffing box 50 with the axis of cylinder rod 111 aligned with the axis of the stuffing box. A coupling means 125 couples the cylinder rod 111 to polished rod 51 traversing stuffing box 50. An hydraulic drive-control unit 130 is coupled to in/out fluid line 112 for operating hydraulic cylinder 110 to produce an operating cycle consisting of an hydraulic power upstroke and a gavity power downstroke. Support arrangement 120 includes choke assembly 70, a pair of support leg assemblies 80A and 80B, and a cylinder support assembly 90 which includes gimbal mounting arrangement 100.

As illustrated in FIG. 1, when the standard polished rod and stuffing box arrangement is utilized, the support arrangement 120 mounts the hydraulic cylinder 110 a distance above the pumping tee 40 which is somewhat greater than the maximum stroke length of the pump driving unit. This means that the bottom of the hydraulic cylinder 110 may be anywhere from eight to twelve feet or more above the top of the pumping tee 40, depending on the stroke length. If the inverted stuffing box arrangement disclosed in the above-referenced parent application were utilized, the hydraulic cylinder 110 would be mounted a short distance above the pumping tee 40. The pump driving unit of this invention may employ either mounting arrangement and stuffing box combination.

Figure 1A:
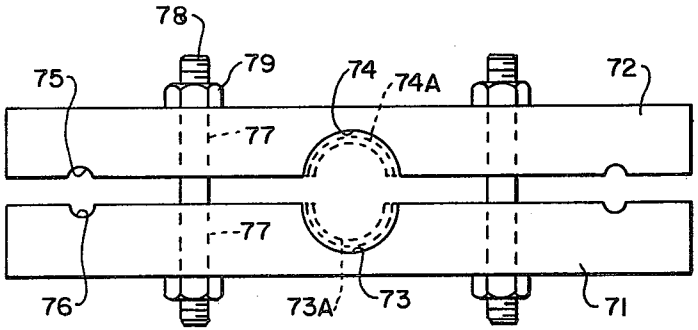
FIG. 1A is a plan view of a choke assembly in accordance with this invention.

Referring now to FIGS. 1 and 1A, the details of the choke assembly 70 will be described. Choke assembly 70 serves both a locating and orienting function and a support or landing block function for the overall cylinder support arrangement 120. Choke assembly 70 includes a pair of collar plates 71 and 72 with complimentary semicircular collar surfaces 73 and 74 formed therein. Collar surfaces 73 and 74 match the outer cylindrical surface configuration of pipe section 41 which mounts the pumping tee 40 to the top of tubing hanger 30. As shown in FIG. 1A, semicylindrical shims 73A and 74A shown in dashed lines may be used within the collar surfaces 73 and 74 to adapt the choke assembly to various tubing section diameters. It should also be understood that the choke assembly 70 could be constructed such that it has diminsions suitable for choking around the well casing 10 as an alternative to choking around the tubing section 41.

Additional semicylindrical edge apertures 75 and 76 are formed in the collar plates 71 and 72 to serve as locating and mounting apertures for the support leg assemblies 80A and 80B. Transverse apertures 77 are provided in each of the collar plates 71 and 72 and cooperate with a fastener arrangement consisting of a threaded bolts 78 and fastening nuts 79 to form a clamping arrangement for tightly clamping collar plates 71 and 72 around tubing section 41. Preferably the bottom surface of collar plates 71 and 72 rest on the top of tubing hanger 30 or on some other horizontal support surface of the wellhead. In this fashion, the collar plates 71 and 72 are mounted at the wellhead in a plane generally perpendicular to the axis of the polished rod 51 and the sucker rod string 57.

Figure 3:
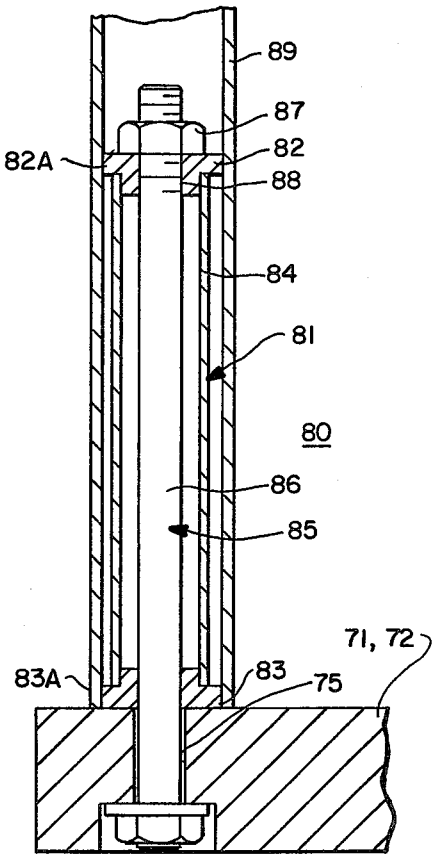
FIG. 3 is a section view of a support leg assembly for an oil well pump driving unit in accordance with this invention taken along the lines 3—3 in FIG. 1.
Figure 2B:
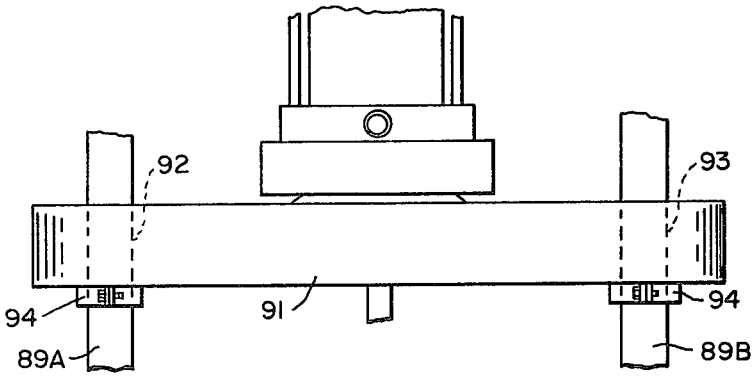
FIG. 2 is a section view of an oil well pump driving unit in accordance with this invention taken along the lines 2—2 in FIG. 1.

FIG. 3 illustrates a preferred form of support leg assemblies 80A and 80B which are generally designated with the reference numeral 80 in FIG. 3. As shown leg assembly 80 consists of a leg mandrel assembly 81 which includes a pair of shouldered cylindrical bearings 82 and 83 located on each end of a pipe section 84. The mandrel assembly 81 is mounted on collar plates 71, 72 by means of a threaded fastener arrangement 85 consisting of, for example, a bolt 86 and a nut 87. It should be understood that any type of threaded fastener may be utilized. The threaded fastener extends through central apertures 88 in the cylindrical bearings 82 and 83. The outer cylindrical surfaces 82A and 83A of the cylindrical bearings 82 and 83 are machined to precisely fit the inner diameter of the long tubing section 89 which serves as one of the support legs for the cylinder support assembly 90. Support leg tubing 89 is preferably a section of standard three inch tubing so that an appropriate length of this tubing may be cut at the installation site to accommodate the required separation distance between the collar plates 71 and 72 and the cylinder support assembly 90.

Cylinder support assembly 90 includes a cylinder support plate 91 having a pair of mounting apertures 92 and 93 which enable the cylinder support plate 91 to be slipped over the support leg tubing sections 89A and 89B. A pair of pipe clamp brackets 94 or any other suitable clamping bracket arrangement are fastened around the support leg tubing sections 89A and 89B to hold the cylinder support plate 91 in position. Preferable the clamping brackets 94 are positioned on the support tubing leg sections 89A and 89B and positioned such that the cylinder support plate 91 will be located in a plane substantially parallel to the plane of the collar plates 71 and 72.

The gimbal mounting arrangement 100 is provided to compensate for any slight tilt of the plane of the cylinder support plate 91 from a position such that the plane of the cylinder support plate 91 is not precisely perpendicular to the axis of stuffing box 50. Gimbal mounting arrangement 100 includes a spherical gimbal bearing 101 which is located on the cylinder support plate 91. The spherical gimbal bearing 101 surrounds an aperture 95 in cylinder support plate 91 through which the cylinder rod 111 extends. As shown in FIG. 2, the spherical gimbal bearing 101 is preferably integrally formed on the cylinder support plate 91. However, it should be apparent that a separate lower bearing plate having this spherical bearing surface on it could be provided. Furthermore, the spherical bearing could be an actual separate spherical bearing mounted in a bearing cup formed in the cylinder support plate 91.

A gimbal plate 102 is provided with a central aperture 103 and a spherically shaped bearing cup 104 in the bottom surface matching the surface of the spherical gimbal bearing 101. The aperture 103 in the gimbal plate 102 is formed to a diameter identical to the outer diameter of a shoulder 113 on the mounting flange 111 of hydraulic cylinder 110 to locate cylinder 110 in position on gimbal plate 102. A pin 112 extends through cylinder mounting flange 111 into a hole 105 in gimbal plate 102 to preclude cylinder 110 from rotation.

With this gimbal mounting arrangement for cylinder 110, the gimbal plate 102 with cylinder 110 mounted thereon is free to tilt slightly in any direction with respect to the cylinder support plate 91 to compensate for any discrepancy in aligning the cylinder support plate 91 exactly perpendicular to the axis of the stuffing box 50. When the cylinder rod 111 is loaded with the rod string 57, the gimbal plate 102 will automatically tilt until the gimbal plate 102 is exactly perpendicular to the axis of the stuffing box 50. In this manner any side-loading on the cylinder 110 and the seals which surround the cylinder rod 111 is eliminated. This will substantially increase the life of the hydraulic cylinder 110. Importantly, this gimbal mounting arrangement eliminates the need to maintain any tight tolerances on manufacturer and assembly of the cylinder support arrangement of this invention.

It should be appreciated that the oil pump driving unit depicted in FIGS. 1–3 may be readily manufactured and shipped in kit form for assembly into an overall functioning unit after it arrives at the wellhead. The assembly operation is relatively straightforward and can be accomplished by a team of two individuals having only a general mechanical ability. The field assembly of the unit would generally proceed in the following fashion. It is assumed that the well casing 10 has already been put in place and the gas tee 20, tubing hanger 30, oil pumping tee 40 and stuffing box 50 have also been installed. The first assembly step is to clamp the choke assembly 70 onto to either well casing 10, if designed for that, or onto the tubing section 41 extending above the tubing hanger 30. This is easily accomplished by setting the two collar plates 71 and 72 on the tubing hanger 30 while tightening the nuts 79 on the threaded rods 78 to clamp the collar plates tightly onto the tubing section 41.

Once the collar plates 71 and 72 are in place, the mandrel assemblies 81 may be mounted to the collar plates. Utilizing the arrangement shown in FIG. 3, the cylindrical bearing 83 would be placed in position on the collar plates 71 and 72 and the pipe section 84 placed on the bearing 83. Then the upper cylindrical bearing 82 would be positioned on the pipe section 84 and the threaded fastener 85 would be extended through the aperture 75 in the collar plate 71, 72 and through the bearings 82 and 83. Then the nut 87 may be tightened to fasten the mandrel arrangement on the collar plates 71 and 72.

Two pieces of three inch pipe are then cut to an appropriate length. The appropriate positions for the clamping brackets 94 are then marked depending on the cylinder stroke length and the type of stuffing box arrangement utilized. The brackets 94 are then positioned at the marked location and secured onto the three inch pipe. The next step is to slide the cylinder support plate 91 over the two three inch pipe sections so that it rests on the clamping brackets 94. This assembly is then lifted over the well tee and the bottoms of the three inch pipe sections are slid over the mandrel assemblies.

The hydraulic fluid hoses from the hydraulic drive/-control unit 130 are attached to the hydraulic cylinder 110 before it is mounted on the cylinder support plate 91. The gimbal plate 102 is placed over the gimbal bearing 101, and then the hydraulic cylinder is lifted over and located on the gimbal plate 102. The cylinder rod 111 is then pulled out and attached to the polished rod coupler 125 which is then attached to the polished rod 51. The weight of the polished rod and attached sucker rod string may then be applied to the cylinder rod so that the cylinder rod 111 will come into alignment with the polished rod by tilting cylinder 110 as necessary on the gimbal arrangement 100. Then the hydraulic cylinder 110 may be clamped to the support leg tubing using a suitable clamping arrangement 130 as shown in FIG. 1. Once the hydraulic drive/control unit 160 has been connected to the cylinder and appropriately set up, pumping of the well may begin.

If an assist cylinder 160 is utilized, it is preferably provided as a tandem cylinder mounted to the cylinder 110 as a complete factory assembled unit as shown in FIG. 1. The hookup and operation of such an assist cylinder unit will be described in connection with the hydraulic circuit arrangement of FIG. 6.

Figure 6:
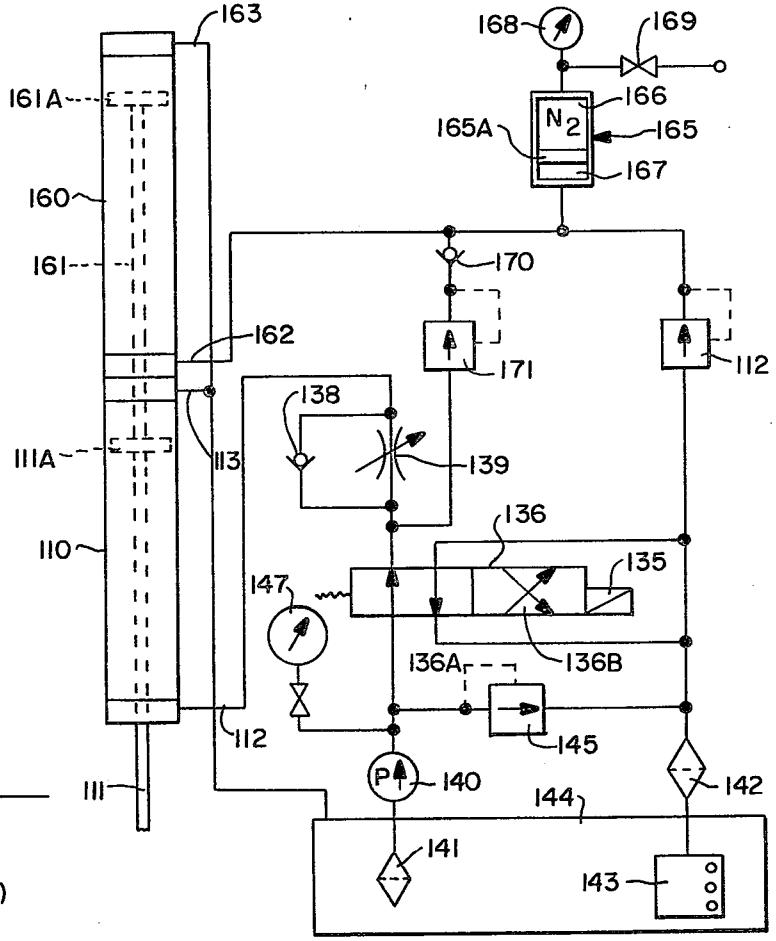
FIG. 6 is a schematic diagram of the hydraulic circuit portion of a hydraulic drive-control unit in accordance with this invention, including the hydraulic circuit for an assist cylinder and accumulator.
Figure 4:
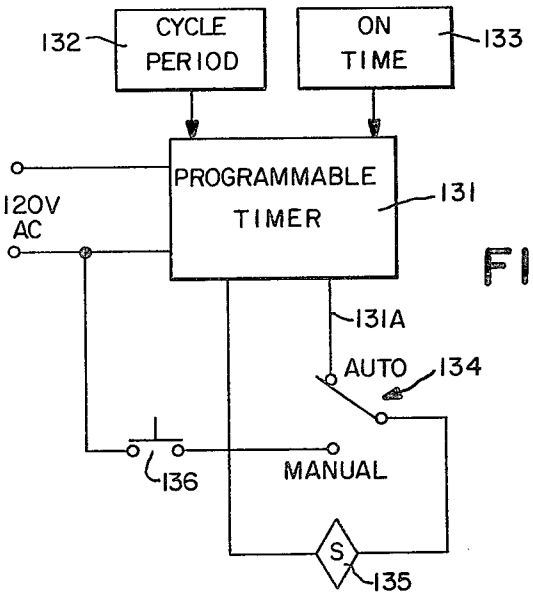
FIG. 4 is a schematic electrical diagram of the electrical portion of a hydraulic drive/control unit in accordance with this invention.
Figure 5:
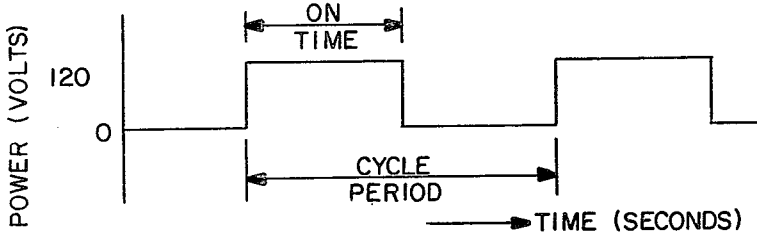
FIG. 5 is an operating cycle diagram for the electrical circuit of FIG. 4.

FIG. 4 shows the electrical circuit of hydraulic drive/control unit 130. A programmable timer 131 which is connected to a source of alternating current provides a program cycle to a valve control solenoid 135 when selector switch 134 is in its automatic position. A cycle period control 132 and an on-time control 133 are utilized to control the program of timer 131. When selector switch 134 is in the manual position, a push botton switch 136 controls the application of electric power to solenoid 135. As shown in FIG. 5, cycle period control 132 determines the length of the on-off cycle period of programmable timer 131. On-time control 133 determines the proportion of the cycle period during which the AC voltage is applied to output lead 131A leading to the selector switch 134. The function of this timed electrical circuit to control the operating cycle of the hydraulic cylinder 110 can be understood from a consideration of the hydraulic circuit depicted in FIG. 6. FIG. 6 also shows assist cylinder 160 and accumulator 165 together with hydraulic circuit components associated with these units. However, these items and their functions will be described later.

As shown in FIG. 6, a hydraulic fluid pump 140 withdraws hydraulic fluid from a reservoir 144 through a strainer 141 and supplies it under pressure to a hydraulic fluid power line 148 which leads to a fluid control valve 136. Fluid control valve 136 has four ports and includes a valve spool which has one position designated 136A in which hydraulic fluid from power line 148 is supplied to the in/out line 112 of hydraulic cylinder 110 through a parallel combination of check valve 138 and a variable restrictor 139. Check valve 138 allows full hydraulic power to be applied to cylinder 110 through the check valve when valve spool 136 is in position 136A. In this position, the hydraulic return line 149 is simply circuited to itself and has no effect on the overall operation. When the valve spool is in the position 136B, hydraulic power line 148 is cross-coupled into return line 149, and in/out line 112 is coupled into return line 149. In this position the hydraulic fluid in cylinder 110 flows back into reservoir 144 through variable restrictor 139.

A strainer 142 is provided in the return line to keep the hydraulic oil clean and a diffuser 143 is provided in the hydraulic fluid reservoir 144 to suppress the introduction of air bubbles into the hydraulic fluid. A hydraulic fluid radiator-type cooling arrangement (not shown) may also be provided. A pilot operated relief valve 145 is coupled between power line 148 and return line 149 as a safety valve to shunt hydraulic fluid between power line 148 and 149 in the event of an unsafe buildup of pressure in power line 148. A pressure gauge 147 connected into power line 148 through a manually operated valve 146 permits metering of the hydraulic fluid pressure in power line 148. The top port 113 of cylinder 110 is vented into the top of reservoir 144 so that the space above cylinder piston 111A will breath clean hydraulic fluid vapors. Alternatively, the port 113 may be vented to the ambient apmosphere through an oil-bath air filter.

The overall operation of hydraulic drive/control unit 130 is as follows. Programmable timer 131 starts in an off condition as shown in FIG. 9, during which no power is applied to solenoid 135. Accordingly, valve spool 136 is in the position designated 136B. In this position the hydraulic cylinder 110 is in a downstroke cycle and, if not already at the end of this downstroke, the weight of the rod string on cylinder rod 111 will push hydraulic fluid through in/out return line 112 and restrictor 139 into the return line 149.

As programmable timer 131 begins its on-time portion of the cycle period, power is applied to solenoid 135 to pull valve element 136 into position 136A. In this position hydraulic fluid is supplied from power line 148 through check valve 138 into cylinder 110 to start a hydraulic power upstroke. The hydraulic power upstroke lasts until the end of the on-time of programmable timer 131. After the timer goes back to its off condition, solenoid 135 deactuates, and the biasing spring 137 pulls valve element 136 back to position 136B. In this position the hydraulic fluid in cylinder 110 is again returned to reservoir 144 through return line 149 and restrictor valve 139 to produce a downstroke of cylinder rod 110.

It should thus be apparent that restrictor valve 139 can be utilized to control the rate of drop of the cylinder rod 111 and the attached sucker rod string during the gravity power downstroke of cylinder 110. Furthermore, the on-time of programmable timer 131 can be utilized to control the stroke length of cylinder 110 and correspondingly the pumping stroke length. By controlling the setting of the cycle period and on-time controls and manipulating the setting of the restrictor valve 139, any combination of stroke length, stroke position, and stroke rate can be achieved.

FIG. 6 also illustrates the hydraulic circuit of assist cylinder 160 and the accumulator 165. As shown schematically in FIG. 6, the cylinder rod 161 of the assist cylinder 160 is coupled in tandem to the cylinder rod 111 of the cylinder 110. Accordingly, as the piston 111A in cylinder 110 is driven upward on an hydraulic power upstroke, the piston 161A within cylinder 160 is also driven upward. The hyraulic fluid in/out line 162 of cylinder 160 is coupled into the hydraulic fluid chamber 167 of accumulator 165. Accumulator 165 contains a gas chamber 166 which may be filled with an relatively inert gas such as nitrogen. On the gravity power downstroke of cylinder 110, assist cylinder 160 also experiences a downstroke and hydraulic fluid is forced through the in/out fluid line 162 into the hydraulic fluid chamber 167 of accumulator 165 to compress the charge of gas in the chamber 166. A movable piston 165A may be utilized in a cylinder type of accumulator to accomplish this compression of the gas within chamber 166. Alternatively, the accumulator may be a bladder type accumulator in which the gas is confined within a compressible bladder like a child's balloon which is alternately compressed and inflated by the hydraulic fluid.

On the hydraulic power upstroke of the cylinder 110 the confined gas within chamber 166 of accumulator 165 will push the hydraulic fluid out of the chamber 167 back into the area of cylinder 160 under piston 161A. The pressure of the compressed gas charge assists in lifting the cylinder rods 161 and 111. Accordingly, the accumulator 165 stores potential energy on the gravity power downstroke of the cylinders 110 and 160, and recovers that potential energy as work by assisting in the lifting of the rod string and column of oil by the hydraulic cylinder 110 on the hydraulic power upstroke.

The pressure within the gas chamber 166 of accumulator 165 is set such that, on the maximum downstroke position of the piston 161A, the pressure exerted on the underside of that piston is slightly less than the weight of the cylinder rod and the sucker rod string so that the down hole pump can bottom out, i.e. complete a downstroke. On the hydraulic power upstroke the pressure within the gas chamber 166 of accumulator 165 will gradually decrease as hydraulic fluid is pushed out of the reservoir 167 into the cylinder 160, but the accumulator will maintain substantial pressure on the piston 161A throughout the upstroke to continue to assist in lifting the weight of the rod string during the pumping cycle.

To maintain the operation of the assist cylinder 160 and accumulator 165 at a substantially optimum maximum and minimum pressure valves, a series connection of a pressure reducing valve 171 and check valve 170 are provided between the hydraulic fluid in/out line 162 of assist cylinder 160 and the power line 148 within the hydraulic circuit for the cylinder 110. As shown in FIG. 6, this connection is achieved through the hydraulic fluid valve 136, but the connection could also be made on the other side of the valve directly to the power line 148. The purpose of this combination of pressure reducing valve 171 and check valve 170 is to assure that the preferred setting of the minimum pressure within the assist cylinder-accumulator combination when the assist cylinder is at the top of it upstroke will be maintained. On each downstroke of assist cylinder 160 a small amount of hydraulic fluid may leak past the seals on the piston 161A. Over a period of time, this loss of hydraulic fluid would result in a decrease in the maximum and minimum pressures at the full upstroke and full downstroke positions of the piston 161A of assist cylinder 160. At a result, the effectiveness of the assist cylinder 160 and accumulator 165 to assist in lifting the rod string and column of well fluid would decline. Pressure reducing valve 171 responds to the pressure in the hydraulic fluid circuit of the assist cylinder 160 and the accumulator 165 at the top of the upstroke. If this pressure falls below a certain minimum value set in the pressure reducing valve 171, the valve will open and admit a small amount of hydraulic fluid through the check valve 170 into the in/out fluid line 162.

Because of the inaccuracy with which the pressure reduction valve 171 accomplishes this function, a pressure relief valve 172 is also provided between the in/out fluid line 162 and the return line 149. Pressure relief valve 172 is set at a value such that the maximum pressure within the hydraulic circuit of assist cylinder 160 and accumulator 165 will not increase above a level which permits the rod string to complete a gravity power downstroke. The combination of the pressure reduction value 171 and the pressure relief valve 172 enables maximum efficiency of the assist cylinder 160 and accumulator 165 to be maintained. The pressure reduction valve 171 can be set a slight amount higher than the minimum desired at the top of the upstroke, but still lower than the value which will permit the weight of the rod string to cause a gravity power downstroke to be initiated. The pressure relief valve 172 may be then set at a somewhat lower value than the maximum pressure at the end of the downstroke to assure that the downstroke will be completed. Thus on each cycle of the cylinders the pressure reduction valve will open to admit a small amount of hydraulic fluid into the hydraulic circuit of the assist cylinder 160 and the accumulator 165 at the top of the upstroke. At the bottom of the downstroke the pressure relief valve 172 will open momentarily to spill some of the hydraulic fluid back into the reservoir 144 to assure that the cylinder rods 111 and 161 become fully extended.

It should be appreciated that the tandem assist cylinder, accumulator and control valve feature of this invention could also be utilized in connection with any of the hydraulic pump driving units disclosed in copending Gilbertson patent applications bearing Ser. Nos. 148,380 and 237,366, filed May 9, 1980 and Feb. 23, 1981 respectively. Furthermore, the assist cylinder and accumulator combination of this invention could be employed with other types of hydraulic cylinder pump driving units.

The accumulator unit 165 is preferably shipped precharged with pressurized gas to a pressure greater than that required. Pressure gauge 168 and valve 169 are used during installation to bleed the gas charge down to a pressure valve appropriate for the particular oil well parameters on which the assist cylinder 160 and accumulator 165 are installed.

While the oil well pump driving unit of this invention and the assist cylinder and accumulator combination of this invention have been described above in terms of preferred and alternative embodiments which might be employed, it should be understood that numerous modifications could be made therein by persons of ordinary skill in the art without departing from the scope of the invention as set forth in the following claims.

What is claimed is:

1. In an oil well pumping apparatus which includes a submerged reciprocating pump mounted in a tubing arrangement communicating with the wellhead, a sucker rod string extending through said tubing arrangement and connected in driving relation with said pump, and a pumping tee and stuffing box arrangement mounted on the casing of the well at the wellhead and including a sealed drive rod arrangement in the stuffing box connected in driving relation to said sucker rod string, a pump driving unit comprising:

an hydraulic cylinder, including a cylinder rod and an in/out hydraulic fluid line;

support means for supporting said hydraulic cylinder over said stuffing box with the axis of said cylinder rod aligned with the axis of said stuffing box;

coupling means for coupling said cylinder rod to said sealed drive rod arrangement; and an hydraulic drive/control means coupled to said in/out fluid line for operating said hydraulic cylinder to produce an operating cycle consisting of an hydraulic power upstroke and a gravity power downstroke; said support means comprising a cylinder support assembly, including a cylinder support plate, and structural means mounting said cylinder support plate above said pumping tee and stuffing box arrangement in a plane generally perpendicular to the axis of said stuffing box, said cylinder support assembly further including gimbal means for supporting said cylinder in an axially floating manner on said cylinder support plate to adjust automatically the orientation of the axis of said cylinder into alignment with the axis of said stuffing box when the weight of said sucker rod string is applied to said cylinder rod, thereby to compensate for any small errors in the positioning of said cylinder support plate perpendicular to the axis of said stuffing box.

2. Apparatus as claimed in claim 1, wherein said hydraulic cylinder includes a mounting flange on a bottom end thereof through which passes said cylinder rod; said cylinder support plate includes an aperture receiving said cylinder rod; and said gimbal means includes a generally spherical gimbal bearing located on a top surface of said cylinder support plate surrounding said cylinder rod aperture, and a gimbal plate supporting said mounting flange of said hydraulic cylinder on a top surface thereof and having a spherically shaped bearing cup formed in a bottom surface thereof to match said spherical gimbal bearing and an aperture therethough generally aligned with said aperture in said cylinder support plate whereby a small degree of tilt in any direction is permitted between said gimbal plate and said cylinder support plate.

3. Apparatus as claimed in claim 2, wherein said gimbal bearing is integrally formed on said top surface of said cylinder support plate, said mounting flange of said cylinder has a cylindrical shoulder projecting from its bottom surface and surrounding said cylinder rod, and said aperture through said top gimbal plate receives said cylindrical shoulder.

4. Apparatus as claimed in claim 1, wherein said structural means comprises:

a choke assembly including a pair of collar plates with complementary semicircular collar surfaces formed thereon matching the outside surface of either said well casing or a tubing element on said wellhead above said casing and a clamping arrangement for tightly clamping said collar plates on said well casing or said tubing elements such that the plane of said collar plates is generally perpendicular to the axis of said stuffing box;

at least a pair of support leg arrangements each including a support leg supported at one end on said collar plates with the other end extending above said pumping tee and stuffing box arrangement; and mounting means for mounting said cylinder support plate on said support legs in a plane substantially parallel to the plane of said collar plates.

5. Apparatus as claimed in claim 4, wherein said collar plates define a pair of support leg locating apertures spaced from said collar surface;

said support leg arrangements each includes a pair of shouldered cylindrical bearings mounted on opposite ends of a section of cylindrical pipe and having central apertures therethrough, a threaded fastener assembly extending through said support leg locating apertures and said cylindrical bearings to mount said bearing and said pipe section on said collar plates, and a support leg in the form of a hollow pipe section fitted tightly over said shouldered cylindrical bearings;

said cylinder support plate having a pair of apertures therein receiving said support legs of said support leg arrangements;

and said mounting means for said cylinder support plate comprises a pair of clamping brackets mounted on said support legs at a selected position and adapted to support said cylinder support plate thereon.

6. In an oil well pumping apparatus which includes a submerged, reciprocating pump mounted in a tubing arrangement communicating with the wellhead, a sucker rod string extending through said tubing arrangement and connected in driving relation with said pump, and a pumping tee and stuffing box arrangement mounted on the casing of the well at the wellhead and including a sealed drive rod arrangement in the stuffing box connected in driving relation to said sucker rod string, a pump driving unit comprising:

an hydraulic cylinder, including a cylinder rod and in/out hydraulic fluid line;

coupling means for coupling said cylinder rod to said sealed drive rod arrangement;

an hydraulic drive/control means coupled to said in/out fluid line for operating said hydraulic cylinder; and support means for supporting said hydraulic cylinder directly above said stuffing box with the axis of said cylinder rod aligned with the axis of said stuffing box, said support means comprising:

a choke assembly including a pair of collar plates with complementary semicircular collar surfaces formed thereon matching the outside surface of either said well casing or a tubing element on said well head above said casing and a clamping arrangement for tightly clamping said collar plates on said well casing or tubing element such that the plane of said collar plates is generally perpendicular to the axis of said stuffing box;

at least a pair of support leg assemblies each including a support leg and leg mounting means for mounting said support leg to said collar plates at a prearranged location with the axes of said support legs perpendicular to the plane of said collar plates and lying in a plane which passes through the axis of said cylindrical collar surfaces on said collar plates;

a cylinder support assembly mounted on said support legs above said pumping tee and stuffing box arrangement and including a cylinder support plate having mounting apertures receiving said support legs, a pair of clamping bracket bracket means mounted on said support legs to support said cylinder support plate and a cylinder mounting arrangement for mounting said hydraulic cylinder on said cylinder support plate.

7. Apparatus as claimed in claim 6, wherein said cylinder mounting arrangement comprises gimbal means for supporting said cylinder on said cylinder support plate in an axially-floating manner to adjust automatically the axis of said cylinder into alignment with the axis of said stuffing box when the weight of the sucker rod string is applied to said cylinder rod thereby to compensate for any small errors in positioning said cylinder support plate perpendicular to the axis of said stuffing box.

8. Apparatus as claimed in claim 6, wherein said collar plates define a pair of support leg locating apertures located on opposite sides of said collar surface and having center lines aligned with the axis of said collar surfaces; and said support leg arrangements each includes a pair shouldered cylindrical bearings mounted on opposite ends of a section of cylindrical pipe and having central apertures therethrough, a threaded fastener assembly extending through said support leg location apertures and said cylindrical bearings to mount said bearings and said pipe section on said collar plates, said support legs comprising of hollow cylindrical pipe sections fitted tightly over said shouldered cylindrical bearings.

9. Apparatus as claimed in claim 6, wherein said cylinder support plate includes an aperture through which said cylinder rod extends; and said gimbal means includes a generally spherical gimbal bearing located on a top surface of said cylinder support plates surrounding said cylinder rod aperture and a gimbal plate supporting said mounting flange of said hydraulic cylinder on a top surface thereof and having a spherically shaped bearing cup formed in a bottom surface thereof to match said spherical gimbal bearing and an aperture therethrough generally aligned with said aperture in said cylinder support plate, whereby a small degree of tilt in any direction is permitted between gimbal plate and said cylinder support plate.

10. Apparatus as claimed in any of claims 1 or 6, wherein said hydraulic drive/control means comprises an hydraulic generator having power and return lines; a fluid control valve coupled to said in/out fluid line, said power line and said return line and including a valve element and a valve element driving arrangement comprising a solenoid actuable to switch said valve element between first and second positions and spring biasing means for biasing said valve element into said first position when said solenoid is deactuated, said first valve element position establishing separate connections between said return line and each of said power line and said in/out line to permit a gravity power downstroke of said cylinder and said second valve element position establishing a connection between said power line and said in/out line to provide an hydraulically powered upstroke for said cylinder; a presettable flow restrictor and a check valve coupled in parallel between said fluid control valve and said in/out line for controlling the rate of fluid transfer out of said cylinder during said downstroke; and control means coupled to said valve driving arrangement for establishing a presettable operating cycle period for said fluid control valve including a presettable first time segment during which said solenoid is actuated to produce said hydraulically powered upstroke.

11. A kit of structural parts for mounting an hydraulic cylinder directly over and in alignment with the axis of a pumping tee and stuffing box arrangement mounted on the casing of an oil well at the wellhead, said kit comprising:

a choke assembly including a pair of collar plates with performed cylindrical collar surfaces matching the outside surface of said casing or a tubing section below said pumping tee and a clamping arrangement adapted to clamp said collar plates on said well casing or said tubing section such that the plane of said collar plates is generally perpendicular to the axis of said stuffing box, said collar plates defining support leg locating apertures located a precise distance from said cylindrical collar surface thereon at a position such that the centerlines of said locating apertures lie in a vertical plane passing through the common axis of said cylindrical collar surfaces and the axis of said stuffing box when said collar plates are clamped on said casing or said tubing section;

a pair of mandrels with associated fastening arrangements adapted to cooperate with said support leg locating apertures in said collar plates to mount said mandrels on said collar plates, said mandrels each having cylindrical exterior surfaces adapted to permit a section of standard tubing to be closely fit thereover to serve as support legs;

a cylinder support arrangement adapted to mount on said sections of standard tubing, said cylinder support arrangement including a cylinder support plate adapted to span said tubing sections and having mounting apertures therein receiving one of said tubing sections, a pair of clamping brackets adapted to be mounted on said tubing sections to support said cylinder support plate thereon, said cylinder support plate having a central aperture therethrough accurately positioned halfway between said mounting apertures with its centerline in the plane of the centerlines of said mounting apertures, and a cylinder mounting arrangement adapted to mount an hydraulic cylinder on said cylinder support plate with a cylinder rod extending through said aperture in said cylinder support plate and the axis of said cylinder substantially aligned with the axis of said stuffing box.

12. Apparatus as claimed in claim 11 wherein said cylinder mounting arrangement comprises a gimbal means located on said cylinder support plate over said central aperture therein for supporting said cylinder in an axially-floating manner to adjust automatically the axis of said cylinder into alignment with the axis of said stuffing box when weight is applied to said cylinder rod after coupling it to a sealed drive arrangement in said stuffing box, thereby compensating for any small errors in positioning said cylinder support plate perpendicular to the axis of said stuffing box.

13. Apparatus as claimed in claim 12, wherein said gimbal means comprises a generally spherical gimbal bearing located on a top surface of said cylinder support plate surrounding said cylinder rod aperture therein, and a gimbal plate supporting said mounting flange of said hydraulic cylinder on a top surface thereof and having a spherically shaped bearing cup formed in a bottom surface thereof to match said spherical gimbal bearing and an aperture therethrough generally aligned with said aperture in said cylinder support plate, whereby a small degree of tilt in any direction is permitted between said gimbal plate and said cylinder support plate.

14. In an oil well pumping apparatus which includes a submerged reciprocating pump mounted in a tubing arrangement communicating with the wellhead, a sucker rod string extending through said tubing arrangement and connected in driving relation with said pump, and a pumping tee mounted on said tubing arrangement, a pump driving unit comprising:

first and second hydraulic cylinders mounted in tandem and having first and second cylinder rods coupled together in common driving relation and first and second hydraulic fluid in/out lines;

mean supporting said hydraulic cylinders directly over and in axial alignment with said pumping tee;

means coupling said first and second cylinder rods in sealed driving relation to said sucker rod string;

hydraulic drive/control means coupled to one of said first and second in/out fluid lines to produce a cylinder operating cycle consisting of a hydraulic power upstroke and a gravity powered downstroke, including a hydraulic generator having hydraulic power and return lines;

an accumulator coupled to the other of said first and second in/out fluid lines and containing a compressible gas charge which is further pressurized by hydraulic fluid from said associated cylinder on said gravity powered downstroke to counteract at least partially the weight of said sucker rod string throughout said hydraulic power upstroke; a pressure reduction valve and a check valve coupled in series between said hydraulic power line and said in/out fluid line associated with said accumulator for controlling the minimum hydraulic fluid pressure in the associated hydraulic cylinder at the top of said hydraulic power upstroke; and a pressure relief valve coupled between said in/out fluid line associated with said accumulator for controlling the maximum hydraulic fluid pressure in said associated hydraulic cylinder at the bottom of said gravity power downstroke.

15. In an oil well pumping apparatus which includes a submerged reciprocating pump mounted in a tubing arrangement communicating with the wellhead, a sucker rod string extending through said tubing arrangement and connected in driving relation with said pump, and a pumping tee mounted on said tubing arrangement, a pump driving unit comprising;

first and second hydraulic cylinders having first and second cylinder rods coupled together in common driving relation and first and second hydraulic fluid in/out lines;

means mounting said first hydraulic cylinder in operative position at said wellhead;

means coupling said first cylinder rod in sealed driving relation to said sucker rod string;

hydraulic drive/control means coupled to said first in/out fluid line to produce an operating cycle for said first and second cylinders consisting of a hydraulic power upstroke and a gravity power downstroke, including a hydraulic generator having hydraulic power and return lines;

an accumulator coupled to said second in/out fluid line and containing a compressible gas charge which is further pressurized by hydraulic fluid from said second hydraulic cylinder on said gravity power downstroke to counteract at least partially the weight of said sucker rod string throughout said hydraulic power upstroke;

a pressure reducing valve and a check valve coupled in series between said hydraulic power line and said second in/out fluid line for controlling the minimum pressure in the second hydraulic cylinder at the top of said hydraulic power upstroke; and a pressure relief valve coupled between said second in/out fluid line and said return line for controlling the maximum pressure in said second hydraulic cylinder at the bottom of said gavity powered downstroke.

16. Apparatus as claimed in claim 14 or claim 15, wherein said hydraulic drive/control mean further comprises a fluid control valve coupled to said first in/out fluid line, said power line and said return line and including a valve element and a valve element driving arrangement comprising a solenoid actuable to switch said valve element between first and second positions and spring biasing means for biasing said valve element into said first position when said solenoid is deactuated, said first valve element position establishing a separate connection between said return line and each of said power line and said in/out line to permit a gravity power downstroke of said hydraulic cylinders and said second valve element position establishing a connection between said power line and said in/out line to provide a hydraulic power upstroke for said cylinders; a presettable flow restrictor and a check valve coupled in parallel between said fluid control valve and said in/out line for controlling the rate of fluid transfer out of said cylinder during said downstroke; and control means coupled to said valve driving arrangement for establishing a presettable operating cycle for said fluid control valve including a presettable first time segment during which said solenoid is actuated to produce said hydraulic power upstroke.

* * * * *